US007165299B2

(12) United States Patent
Mita et al.

(10) Patent No.: US 7,165,299 B2
(45) Date of Patent: Jan. 23, 2007

(54) METHOD OF MANUFACTURING AN INK-JET RECORDING HEAD

(75) Inventors: Tsuyoshi Mita, Kawasaki (JP); Kazuaki Kurihara, Kawasaki (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 36 days.

(21) Appl. No.: 11/104,503

(22) Filed: Apr. 13, 2005

(65) Prior Publication Data

US 2005/0174395 A1 Aug. 11, 2005

Related U.S. Application Data

(60) Division of application No. 10/200,490, filed on Jul. 23, 2002, now Pat. No. 6,929,353, which is a continuation of application No. PCT/JP00/00918, filed on Feb. 18, 2000.

(51) Int. Cl.
*H04R 17/00* (2006.01)
*B41J 2/045* (2006.01)

(52) U.S. Cl. ..... 29/25.35; 29/890.1; 29/831; 347/68

(58) Field of Classification Search ..... 29/25.35, 29/830, 831, 832, 842, 844, 845; 347/68, 347/70–72

See application file for complete search history.

(56) References Cited

U.S. PATENT DOCUMENTS 5,539,982 A * 7/1996 Hosono et al. ..... 29/890.1
5,793,393 A * 8/1998 Coven ..... 347/65
5,907,340 A * 5/1999 Katakura et al. ..... 347/71
6,062,681 A * 5/2000 Field et al. ..... 347/65

FOREIGN PATENT DOCUMENTS

| | | |
|---|---|---|
| JP | 7-299904 | 11/1995 |
| JP | 11-10882 | 1/1999 |
| JP | 11-58737 | 3/1999 |
| JP | 11-138810 | 5/1999 |
| JP | 11-291483 | 10/1999 |
| JP | 11-348280 | 12/1999 |
| JP | 2000-62168 | 2/2000 |
| JP | 2000-71448 | 3/2000 |

* cited by examiner

*Primary Examiner*—A. Dexter Tugbang
*Assistant Examiner*—Tai Van Nguyen
(74) *Attorney, Agent, or Firm*—Armstrong, Kratz, Quintos, Hanson & Brooks, LLP

(57) ABSTRACT

A method of manufacturing an ink-jet recording head includes an individual electrode having an individual electrode main body formed at a position corresponding to an ink chamber and an individual electrode lead-out part for supplying power, a piezoelectric element formed to contact the individual electrode, and a diaphragm formed to contact the piezoelectric element. The individual electrode lead-out part is connected to the individual electrode main body from a position offset from a face including an electrode face of the individual electrode main body, and the piezoelectric element is formed into a shape corresponding to the individual electrode main body.

2 Claims, 13 Drawing Sheets

METHOD OF MANUFACTURING AN INK-JET RECORDING HEAD (This application is a divisional application of Ser. No. 10/200,490, filed Jul. 23, 2003 now U.S. Pat. No. 6,929,353, which is a continuation of international application PCT/JP00/00918, filed Feb. 18, 2000)

TECHNICAL FIELD

The present invention relates to ink-jet recording heads, and more particularly to an ink-jet recording head manufactured by using a thin-film deposition technology employed in a semiconductor manufacturing process.

Recently, a printer including an ink-jet recording head using a piezoelectric element has been devised. The ink-jet recording head enjoys advantages such as simple structure, less driving power consumption, high resolution, facility in colorization, and reduced noise. Therefore, the ink-jet recording head is expected to be the mainstream of future ink-jet recording heads.

BACKGROUND ART

FIG. 1 shows a conventional ink-jet recording head. FIG. 1(A) is a diagram showing the outline of a configuration of individual electrodes 102 and their periphery of an ink-jet recording head 100. FIG. 1(B) shows the outline of a configuration of the ink-jet recording head 100 of FIG. 1(A) viewed in the direction indicated by the arrows A—A. Normally, the ink-jet recording head 100 includes numerous nozzles 107 so as to form characters or images by numerous ink dots, while only two head parts are shown in FIGS. 1(A) and (B).

The ink-jet recording head 100 includes an ink supply system including ink chambers 106, a pressure-generating system including piezoelectric elements 103 generating pressure inside the ink chambers 106, and a nozzle plate 108 having nozzles 107 spraying ink droplets in accordance with the pressure inside the ink chambers 106.

The ink supply system includes a common ink channel 113 supplying ink from an ink tank not shown in the drawings and ink supply channels 112 connecting the common ink channel 113 to each ink chamber 106.

The pressure-generating system includes a diaphragm 104 forming the wall of one side of each ink chamber 106, the piezoelectric elements 103 provided on the diaphragm 104, and the individual electrodes 102 provided on the piezoelectric elements 103. The diaphragm 104, which is formed of a conductive material such as Cr or Ni—Cr, serves also as a common electrode and is provided to cover all the ink chambers 106. The diaphragm 104, however, is joined firmly to the peripheral wall part of each ink chamber 106, and oscillates separately for each ink chamber 106. Oscillation isolation is provided so that no adjacent ink chambers 106 are affected by each other's oscillation.

Each ink chamber 106 is provided with the corresponding individual piezoelectric element 103 and individual electrode 102. The piezoelectric element 103, when supplied with an electric charge between the individual electrode 102 and the diaphragm 104 (common electrode), is displaced proportional to the amount of charge. Due to this displacement, the diaphragm 104 is bent to generate pressure inside the ink chamber 106, thereby spraying ink from the nozzle 107 so that recording such as printing is performed on a recording medium. At this point, the charge is supplied to each piezoelectric element through an individual driving signal 114 from a printer main body (not shown in the drawings) via the corresponding individual electrode 102 and the diaphragm 104.

In the ink-jet recording head 100, the nozzles 107 are positioned to oppose the diaphragm 104 with the ink chambers 106 being formed therebetween.

In the ink-jet recording head 100, the individual electrodes 102, the diaphragm 104, and the piezoelectric elements 103 are required to be formed into extremely thin films using metallic and piezoelectric materials. For this purpose, recently, thin-film deposition technologies such as sputtering and etching employed in the field of semiconductor manufacture have been used to manufacture ink-jet recording heads.

A brief description will be given, with reference to FIG. 1(C) showing a layer structure of the ink-jet recording head 100, of a manufacturing process thereof. FIG. 1(C) shows the outline of a configuration of the ink-jet recording head 100 of FIG. 1(B) viewed in the direction indicated by the arrows B—B.

The ink-jet recording head 100 is manufactured by laminating a plurality of layers (films) on a magnesium oxide (MgO) substrate 101, for instance. These layers are processed into necessary shapes and laminated successively so as to be formed finally into the ink-jet recording head 100. In FIG. 1, reference numeral 101 denotes the substrate, which is removed by etching in the final step of manufacturing but, in some cases, is partially preserved for reinforcing the ink-jet recording head 100. The preserved part of the substrate 101 is shown in the ink-jet recording head 100 shown in FIG. 1.

If a thin-film deposition technology is employed in manufacturing the ink-jet recording head 100, a metal thin film can be formed on the substrate 101 one at a time by sputtering, and a layer having a desired pattern can be formed one at a time by performing etching after a resist process. Further, a plurality of layers to be processed into the same shape are processed at the same time in a single etching process after all the layers are laminated. Thereby, the ink-jet recording head 100 can be manufactured efficiently.

In the ink-jet recording head 100 shown in FIG. 1(C), the individual electrode 102 and the piezoelectric element 103 are required to have substantially the same shape. Therefore, in terms of manufacturing efficiency, an individual electrode formation layer and a piezoelectric element formation layer are etched, after being successively formed, so that the individual electrode 102 and the piezoelectric element 103 are simultaneously formed.

When the ink-jet recording head 100 is manufactured by using the thin-film deposition technology as described above, however, the piezoelectric element 103 provided to bend the diaphragm 104 also exists under an individual electrode lead-out part 102A. Therefore, when the driving signal 114 is supplied to the piezoelectric element 103, the piezoelectric element 103 is also displaced unnecessarily under the lead-out part 102A. When the piezoelectric element 103 is thus displaced where the piezoelectric element 103 is not required to, the ink supply channel 112 is deformed, for instance, so that the particle characteristic of ink sprayed from the nozzle 117 is adversely affected. Further, it becomes difficult to reduce the cost of the driver, which should include capacitance for driving the piezoelectric element 103 where the piezoelectric element 103 is not required to be driven. Moreover, the individual electrode lead-out part 102A, which is formed to be extremely thin, for instance, 0.2 μm, and narrow in width, may generate heat or be broken, and thus is of questionable reliability.

Accordingly, a principal object of the present invention is to provide an ink-jet recording head having no piezoelectric element in a part where no piezoelectric element is required and including an individual electrode lead-out part having a cross section allowing smooth power supply, and a method of manufacturing the same.

DISCLOSURE OF THE INVENTION

The above object is achieved by an ink-jet recording head including an individual electrode having an individual electrode main body formed at a position corresponding to an ink chamber and an individual electrode lead-out part for supplying power, a piezoelectric element formed to contact the individual electrode, and a diaphragm formed to contact the piezoelectric element, wherein the individual electrode lead-out part is connected to the individual electrode main body from a position offset from a face including an electrode face of the individual electrode main body, and the piezoelectric element is formed into a shape corresponding to the individual electrode main body.

According to the present invention, the piezoelectric element exists in the part corresponding to the individual electrode main body, and does not exist in the individual electrode lead-out part. Accordingly, the particle characteristic is prevented from being deteriorated by displacement caused by the existence of the piezoelectric element in a part where no piezoelectric element is required to be, and there is no need to include capacitance for an unnecessary part of the piezoelectric element. Therefore, the printing characteristic of the ink-jet recording head is improved and reduction in driving cost is realized in the ink-jet recording head.

Further, the individual electrode lead-out part of the ink-jet recording head, which, in the manufacturing process, can be formed separately from the individual electrode main body at a position offset therefrom, is allowed to have a sufficient cross-sectional area as a power supply channel. Therefore, the individual electrode lead-out part is free of heat generation and line breakage, so that the reliability of the ink-jet recording head is increased.

Additionally, it is preferable that the individual electrode lead-out part be joined to the individual electrode main body with a surface of the individual electrode lead-out part being in contact with a surface of the individual electrode main body in the ink-jet recording head.

According to this configuration, the surface of the individual electrode lead-out part is joined to the electrode face of the individual electrode main body. Therefore, their joining is strengthened so that the reliability of the ink-jet recording head is further increased.

A printer including the above-described ink-jet recording head is reliable with an improved printing characteristic and reduced driving power.

The above object is also achieved by a method of manufacturing an ink-jet recording head including a step of simultaneously patterning an individual electrode layer and a piezoelectric element layer after successively forming the individual electrode layer and the piezoelectric element layer on a substrate, the method including the step of forming a groove for forming an individual electrode lead-out part in the substrate and filling a conductive material into the groove before forming the individual electrode on the substrate.

According to this invention, the conductive material formed into the individual electrode lead-out part is filled into the groove before the individual electrode layer is formed on the substrate. Therefore, by forming the groove so that the individual electrode lead-out part can have such a cross section that allows sufficient power supply, the individual electrode lead-out part can be formed as desired in the manufactured ink-jet recording head.

Further, in the manufacturing process, the individual electrode layer and the piezoelectric element layer are patterned simultaneously, so that processing can be performed with efficiency as conventionally. According to the manufacturing method of the present invention, however, no consideration is required of formation of the individual electrode lead-out part. Therefore, patterned in this process are the individual electrode (individual electrode main body) formed at the position corresponding to the ink chamber and the piezoelectric element.

According to the present invention, an ink-jet recording head in which no piezoelectric element exists under the individual electrode lead-out part can be easily formed by making a simple alteration to the conventional thin-film deposition technology.

Additionally, in the above-described ink-jet recording head manufacturing method, it is preferable that the groove be formed up to a position where the groove overlaps an individual electrode main body formed in the step of patterning the individual electrode layer. In an ink-jet recording head manufactured by filling the conductive material beforehand into the groove thus formed, the surface of the individual electrode lead-out part is in contact with the electrode face of the individual electrode main body. Therefore, a more reliable ink-jet recording head can be manufactured.

As describe above, the individual electrode of the present invention is composed of the individual electrode main body and the individual electrode lead-out part that is formed of the conductive material filled into the groove formed in the substrate. Further, the individual electrode main body is formed by processing the individual electrode layer formed on the substrate. Therefore, there is a vertical difference between the position where the individual electrode main body is formed and the position where the individual electrode lead-out part is formed.

A condition in which the individual electrode lead-out part has its surface contacting the electrode face of the individual electrode main body refers to a condition in which part of the electrode face of the individual electrode main body overlaps the linear tip of the individual electrode lead-out part. In this specification, a description that the individual electrode lead-out part is connected to the individual electrode main body at a position offset from the face including the electrode face of the individual electrode main body refers not only to such a condition of connection through surface contact but also to a condition in which the individual electrode lead-out part is not elongated enough to have its surface contacting the electrode face of the individual electrode main body and therefore remains in linear contact with the individual electrode main body.

Further, the rate of reduction in capacitance according to the ink-jet recording head of the present invention is given by the following equation:

Rate of reduction in capacitance (%)=(Area of individual electrode lead-out part)*100/(Area of piezoelectric element including individual electrode lead-out part).

BRIEF DESCRIPTION OF THE DRAWINGS

FIG. 1 shows a conventional ink-jet recording head, in which

BEST MODE FOR CARRYING OUT THE INVENTION

A description will now be given, with reference to the drawings, of a method of manufacturing an ink-jet recording head according to the present invention.

[First Embodiment]

Figure 1A:
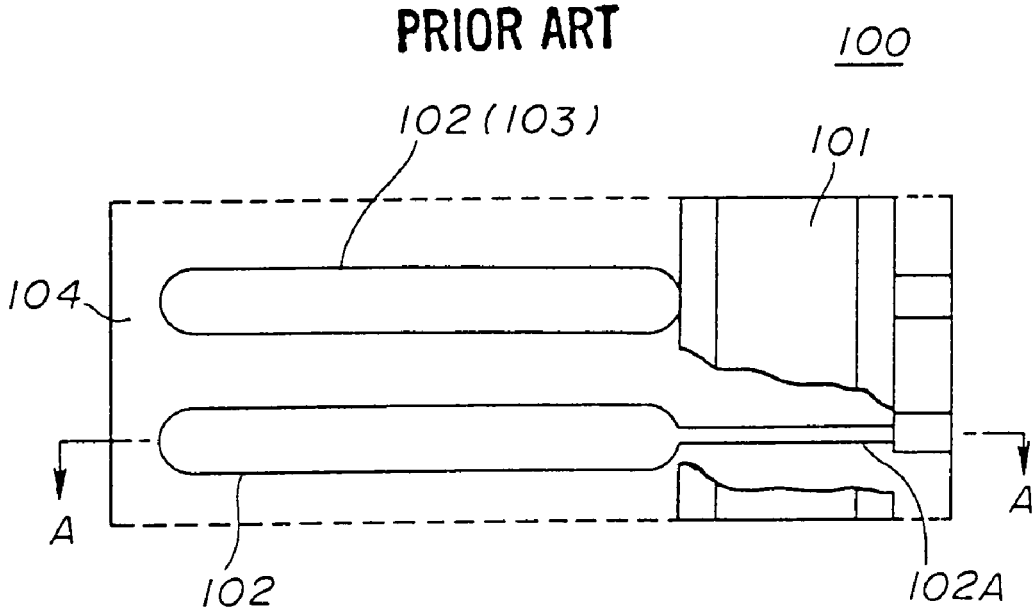
FIG. 1(A) PRIOR ART
FIG. 1(A) is a diagram showing the outline of a configuration of individual electrodes and their periphery of the ink-jet recording head.
Figure 1B:
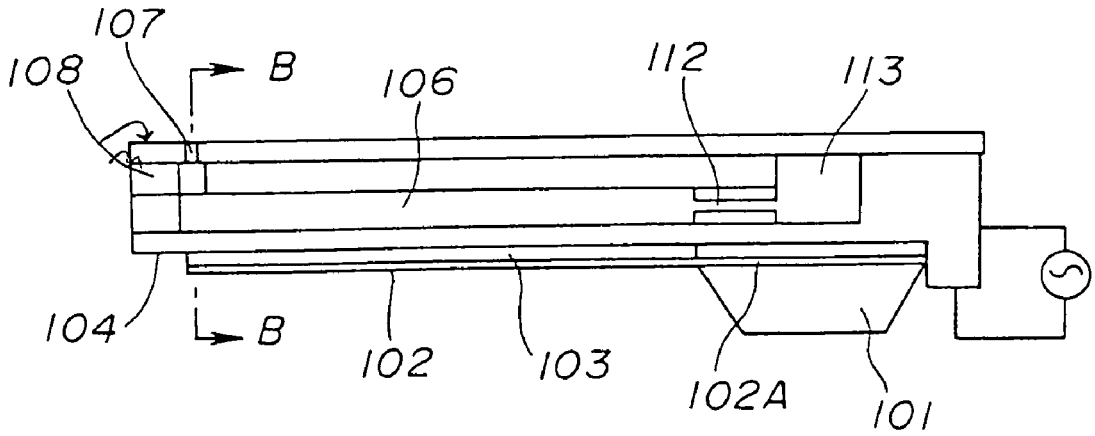
FIG. 1(B) PRIOR ART
FIG. 1(B) is a diagram showing the outline of a configuration of the ink-jet recording head of FIG. 1(A) viewed in a direction of arrows A—A.
Figure 1C:
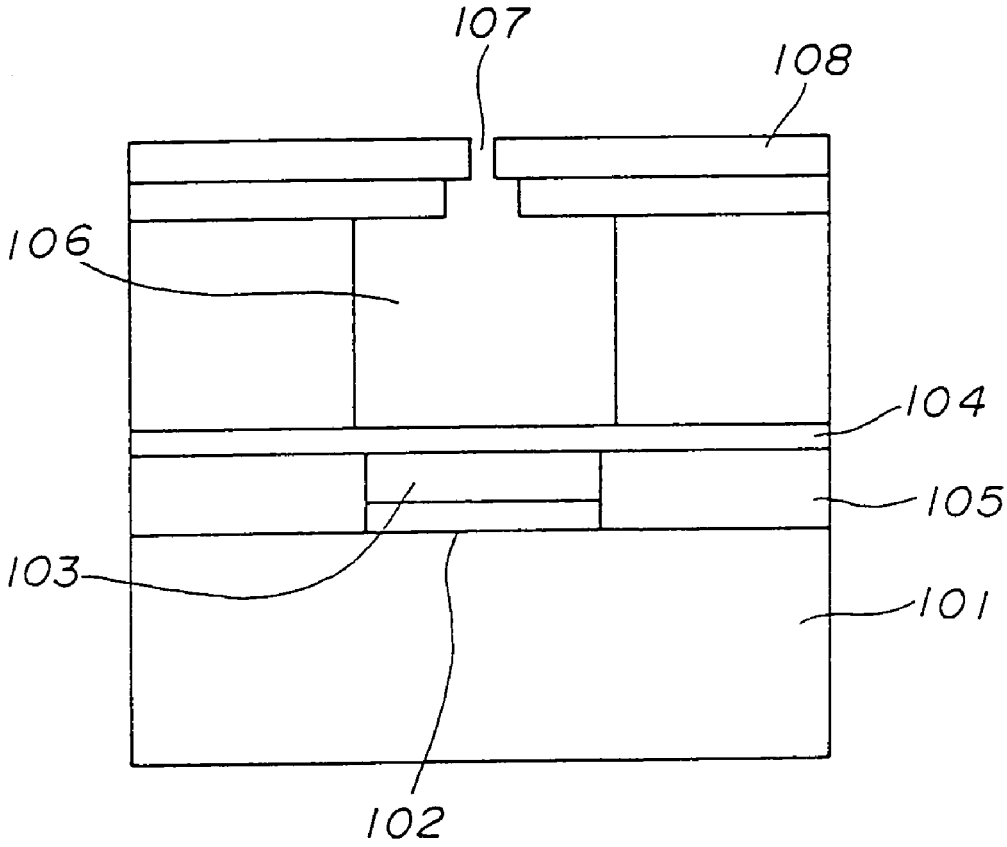
FIG. 1(C) PRIOR ART
FIG. 1(C) is a diagram showing the outline of a configuration of the ink-jet recording head of FIG. 1(B) viewed in a direction of arrows B—B.
Figure 2A:
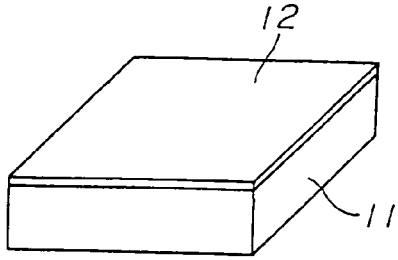
FIG. 2 is a diagram showing step by step a process for manufacturing an ink ejection energy generating part of the ink-jet recording head according to a first embodiment.
Figure 2B:
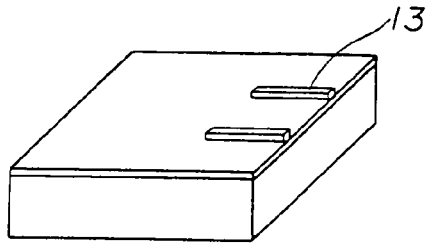
Figure 2C:
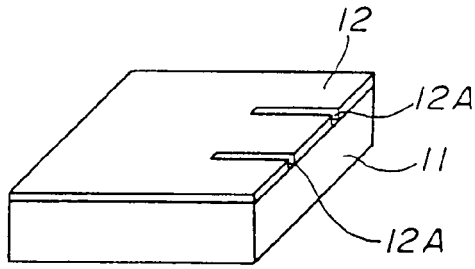
Figure 2D:
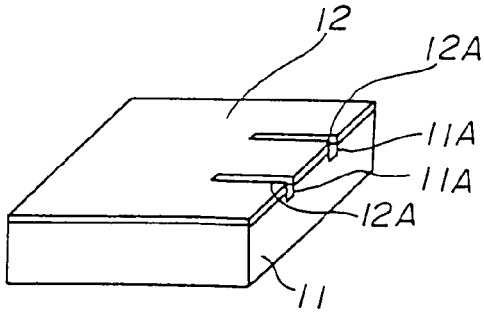
Figure 2E:
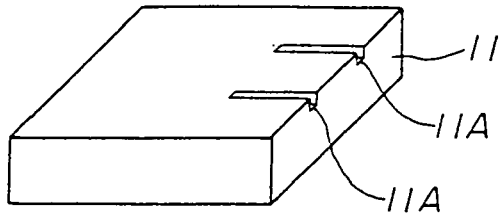
Figure 2F:
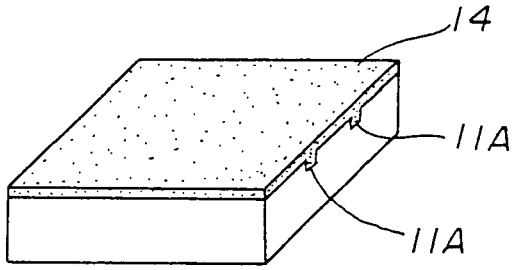
Figure 2G:
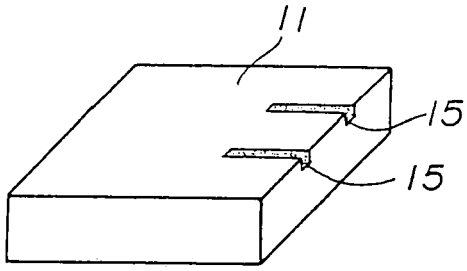
Figure 2H:
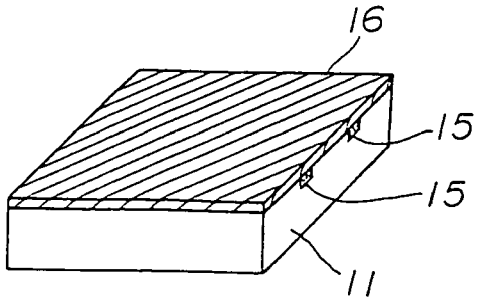
Figure 2I:
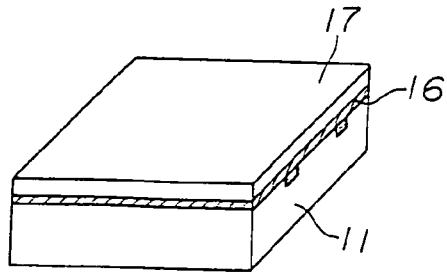
Figure 2J:
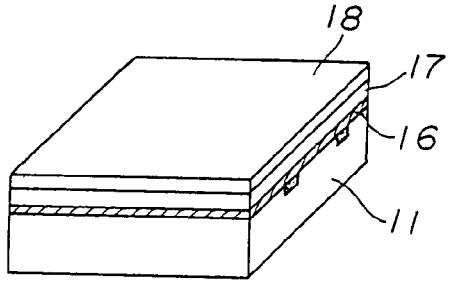
Figure 2K:
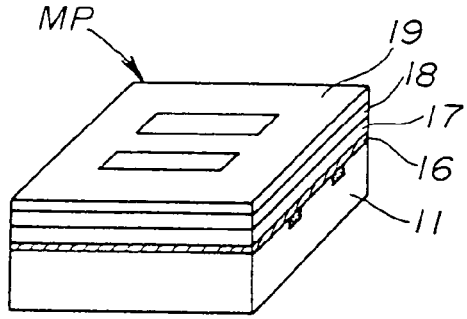
Figure 2L:
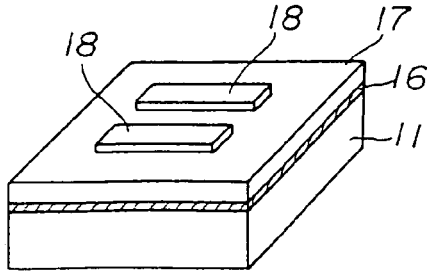
Figure 2M:
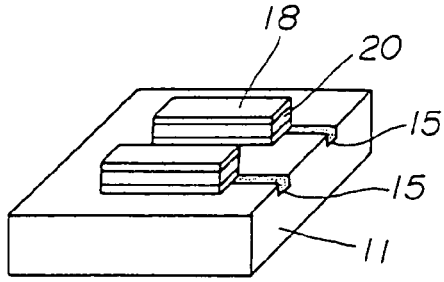
Figure 2N:
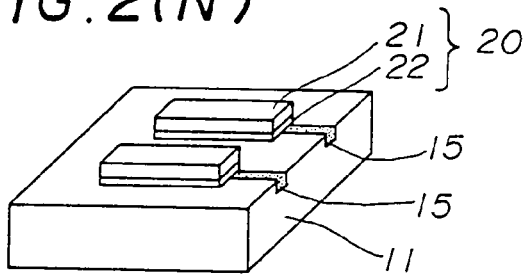
Figure 2O:
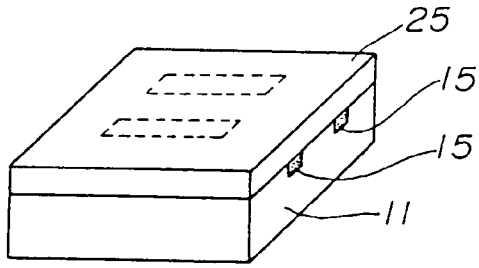
Figure 2P:
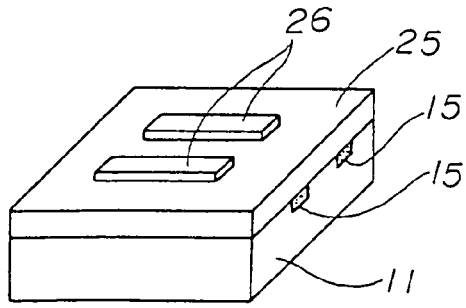
Figure 2Q:
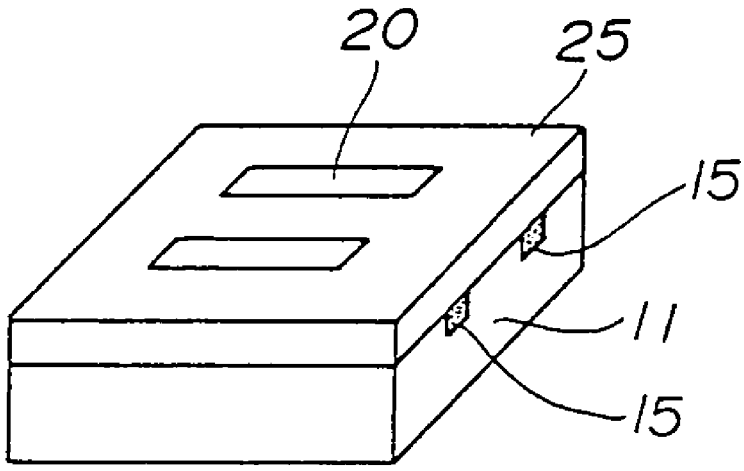
Figure 2R:
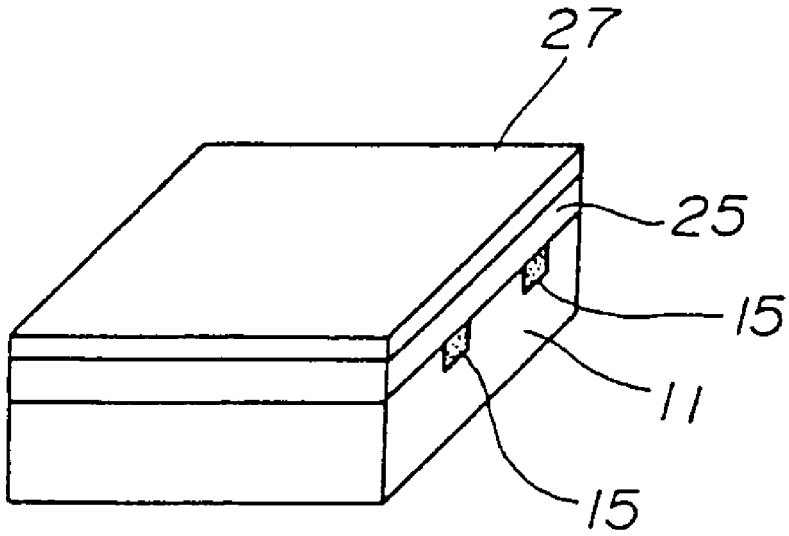
Figure 3:
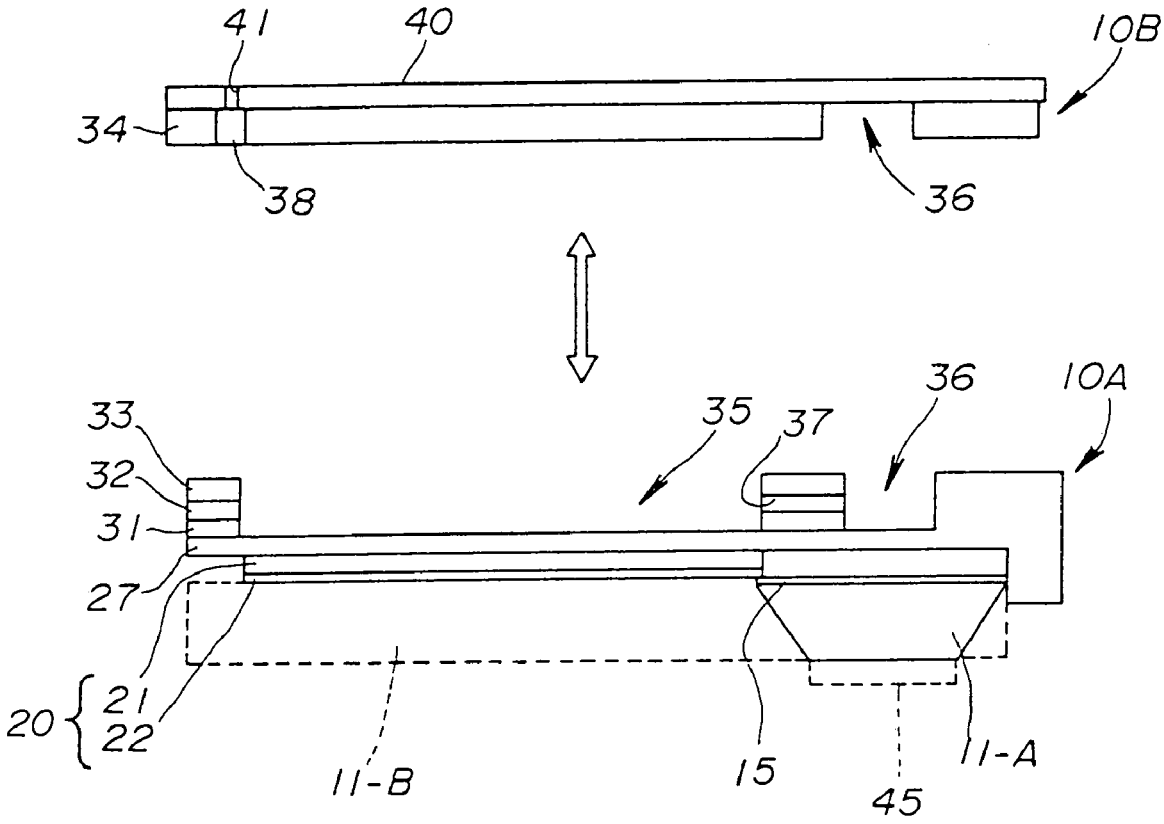
FIG. 3 is a diagram showing joining of the ink ejection energy generating part and an ink-ejecting part of the ink-jet recording head of the first embodiment.

FIGS. 2 and 3 show each manufacturing step of an ink-jet recording head manufactured by using a thin-film deposition technology.

As shown in FIG. 3, an ink-jet recording head 10 of this embodiment is composed of an ink ejection energy generating part 10A as a half body including piezoelectric elements 21 and generating energy for spraying ink and an ink-ejecting part 10B as a half body including nozzles 41 and spraying ink outward in the form of ink droplets.

The piezoelectric elements 21 and individual electrodes 22 are thin films formed in the ink ejection energy generating part 10A. A description will be given, step by step, based on FIG. 2, of a manufacturing process of the ink ejection energy generating part 10A.

In FIG. 2(A), a dry film resist (DF) 12 is laminated on a substrate 11. Magnesium oxide (MgO), for instance, can be used for the substrate 11.

In FIG. 2(B), the dry film resist 12 is exposed with masks 13 for forming electrode patterns serving later as individual electrode lead-out parts being placed thereon. The width of each mask 13 corresponds to that of each individual electrode lead-out part formed later.

In FIG. 2(C), after development is performed, the masks 13 are removed. Under the masks 13, the dry film resist 12 is removed and cutouts 12A are formed. The MgO substrate 11 is exposed in these parts.

In FIG. 2(D), in the cutouts 12A, the MgO substrate 11 is etched by ion milling so that grooves 11A are formed. Later, the lead-out electrodes are formed based on the grooves 11A. Therefore, the depth of this ion milling corresponds to the depth of the electrode of each individual electrode lead-out part. At this point, ion milling can be performed using argon (Ar) gas, for instance.

In FIG. 2(E), the dry film resist 12 is removed. At this point, the grooves 11A each of a given width and depth are formed on the surface of the substrate 11. The width and depth defines the cross section of each individual electrode lead-out part.

In FIG. 2(F), an electrode layer 14 of platinum (Pt), for instance, is formed on the entire surface of the substrate 11 by sputtering. The electrode layer 14 is for forming the individual electrode lead-out parts, and Pt is also filled into the grooves 11A. In addition to platinum, gold (Au) can be used for the electrode layer 14.

In FIG. 2(G), Pt is preserved only inside the grooves 11A, and polishing is performed until the surface of the MgO is planarized. The Pt left inside the grooves 11A at this point later becomes individual electrode lead-out parts 15.

Through the above-described steps, the individual electrode lead-out parts 15 can be formed separately from the individual electrode main bodies 22. In the following, the ink ejection energy generating part 10A of the ink-jet recording head is formed through steps similar to those conventional.

In FIG. 2(H), in order to form the later-described individual electrode main bodies 22, a Pt film is again formed on the MgO substrate 11 by sputtering as an individual electrode formation layer 16.

In FIG. 2(I), a piezoelectric element formation layer 17 is formed by sputtering over the entire surface of the individual electrode formation layer 16 on the MgO substrate 11. A piezoelectric material such as PZT (Lead Zirconate Titanate) can be used for the piezoelectric element formation layer 17.

In FIG. 2(J), a dry film resist 18 is laminated on the upper surface of the piezoelectric element formation layer 17.

In FIG. 2(K), the dry film resist 18 is exposed with a mask 19 having a pattern for forming the piezoelectric elements and the individual electrodes (hereinafter each pair of the piezoelectric element and the individual electrode may be referred to as an energy-generating element) being placed thereon. The pattern MP of the mask 19 has such an arrangement that the energy-generating elements are formed in positions corresponding to respective ink chambers. Unlike the conventional pattern, this pattern MP is required to have no lead-out parts formed on the individual electrodes. Therefore, the pattern MP is formed to have a shape corresponding to the individual electrode main bodies.

In FIG. 2(L), the pattern MP of the mask 19 is developed. By this development, the dry film resist 18 remains at positions corresponding to the energy-generating elements, but is removed from the other part so that the piezoelectric element formation layer 17 is exposed therein.

In FIG. 2(M), the part other than the energy-generating elements on which the dry film resist 18 is formed is etched by ion milling as in FIG. 2(D). By this ion milling, energy-generating elements 20 remain under the dry film resist 18, and the MgO substrate 11 is exposed in the other part. The individual electrode lead-out parts 15 are also exposed so as to form part of the surface of the MgO substrate 11.

In FIG. 2(N), the dry film resist 18 is removed. The energy-generating elements 20 each formed of the individual piezoelectric element 21 and the individual electrode main body 22 are formed on the MgO substrate 11 at the given positions so that the individual electrode lead-out parts 15 are connected to the individual electrode main bodies at positions offset from the faces including electrode faces of the individual electrode main bodies. As previously described, the positions of the individual electrode lead-out parts 15 can be adjusted by the grooves 11A formed in the MgO substrate 11. In this embodiment, the individual electrode main bodies 22 and the individual electrode lead-out parts 15 are in slight contact.

In FIG. 2(O), a photosensitive liquid polyimide 25 is applied on the surface of the MgO substrate 11 on which surface the energy-generating elements 20 are formed.

In FIG. 2(P), the photosensitive liquid polyimide 25 is exposed with masks 26 corresponding to the pattern of the energy-generating elements 20 being placed thereon.

In FIG. 2(Q), the exposed photosensitive liquid polyimide 25 is developed based on the pattern of the masks 26 so that the unexposed part (upper surface parts of the energy-generating elements 20) is removed.

In FIG. 2(R), a chromium (Cr) film, for instance, is formed by sputtering on the entire surface (on which the energy-generating elements 20 are formed) of the MgO substrate 11, so that a diaphragm layer 27 is formed. Through each of the above-described steps, the basic skeleton of the half body that generates energy for spraying ink, or the ink ejection energy generating part 10A, of the ink-jet recording head 10 is formed. The diaphragm 27 may be any conductive thin film serving as a common electrode and be formed of Ni—Cr.

Next, a description will be given, based on FIG. 3, of a process of joining the ink ejection energy generating part 10A and the other half body of the ink-ejecting part 10B into the ink-jet recording head 10. FIG. 3 is a diagram showing the way the ink ejection energy generating part 10A and the ink-ejecting part 10B are joined.

First, a description will be given of a joining preparation process for the ink ejection energy generating part 10A shown on the lower side in FIG. 3.

A layer of a dry film resist 31 (first DF layer) is formed on the surface of the Cr diaphragm 27 (which surface is reverse to the surface thereof on the energy-generating element 20 side) so that a pattern of space intended for pressure chambers 35 and space intended for a common ink channel 36 is exposed.

Likewise, a layer of a dry film resist 32 (second DF layer) is formed so that a pattern of space intended for ink supply channels 37, the pressure chambers 35, and the common ink channel 36 is exposed.

Further, a layer of a dry film resist 33 (third DF layer) is formed so that a pattern of space intended for the pressure chambers 35 and the common ink channel 36 is exposed.

Finally, the dry film resists 31 through 33 are developed so that unwanted parts are removed, and thereby, the pressure chambers 35, the common ink channel 36, and the ink supply channels 37 are formed on the surface of the Cr diaphragm 27. Thereby, the ink ejection energy generating part 10A is formed.

Next, a description will be given of a joining preparation process for the ink-ejecting part 10B shown on the upper side in FIG. 3.

A dry film resist 34 is laminated on a stainless steel nozzle plate 40 having nozzle holes 41 formed therein. Next, a pattern of ink guide channels 38 and the common ink channel 36 is exposed. The dry film resist 34 is developed so that unwanted parts are removed, and thereby, the ink guide channels 38 and the common ink channel 36 are formed on the nozzle plate 40. Thereby, the ink-ejecting part 10B is formed.

Further, the ink ejection energy generating part 10A and the ink-ejecting part 10B that are thus prepared for joining are joined. The dry film resists 31 through 34 are hardened by applying pressure and heat thereto so that the MgO substrate 11 through the nozzle plate 40 are integrated.

Finally, a resist 45 is applied on the surface of the MgO substrate 11 and is exposed so that the MgO substrate 11 is patterned with a required shape. This patterning is performed to remove the MgO substrate 11 so that the surfaces of the individual electrode main bodies 22 of the energy-generating elements 20 are exposed so as to allow the individual piezoelectric elements 21 to deform and bend the diaphragm 27 when supplied with charges. In order to reinforce the strength of the finished ink-jet recording head 10, exposure may be performed so that part of the MgO substrate 11 is preserved. In this embodiment, patterning is performed so that an MgO substrate 11-B on the energy-generating elements 20 is removed and an MgO substrate 11-A positioned to correspond to the individual electrode lead-out parts 15 is preserved.

Figure 4A:
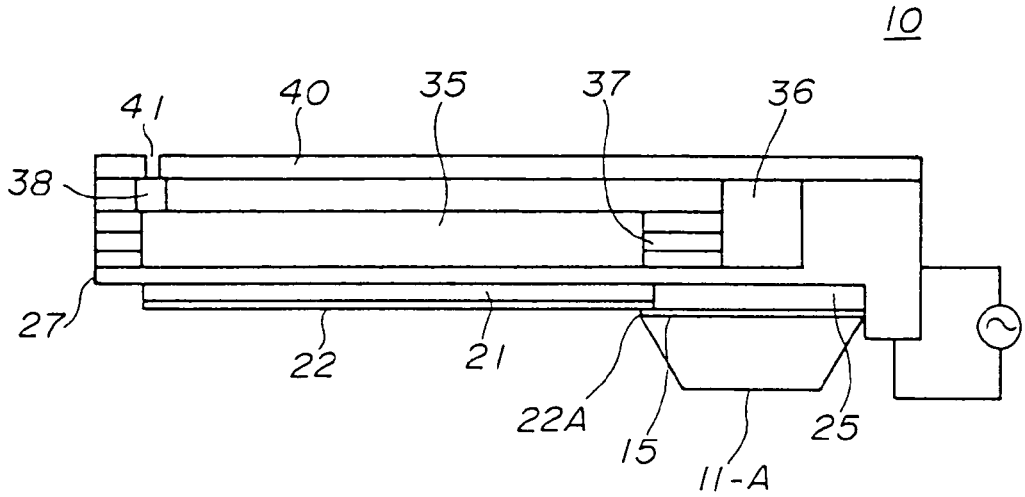
FIG. 4(A) is a cross-sectional view of the ink-jet recording head of the first embodiment, showing the outline of a configuration thereof.
Figure 4B:
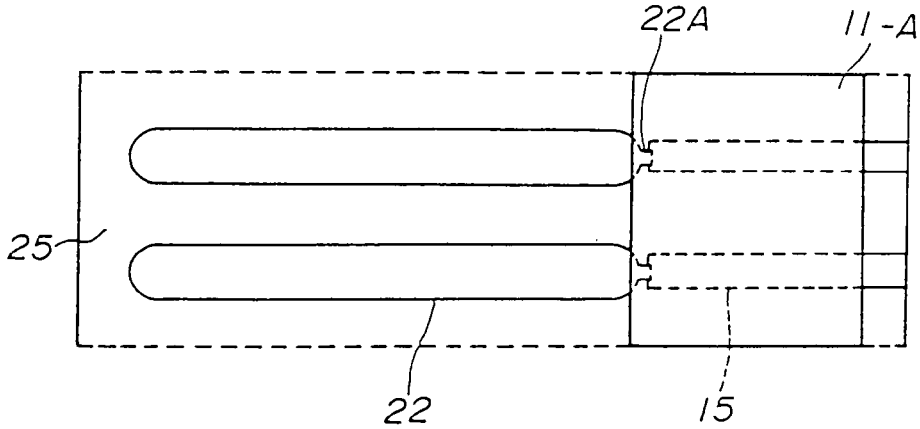
FIG. 4(B) is a bottom view of the ink-jet recording head of FIG. 4(A)
Figure 5:
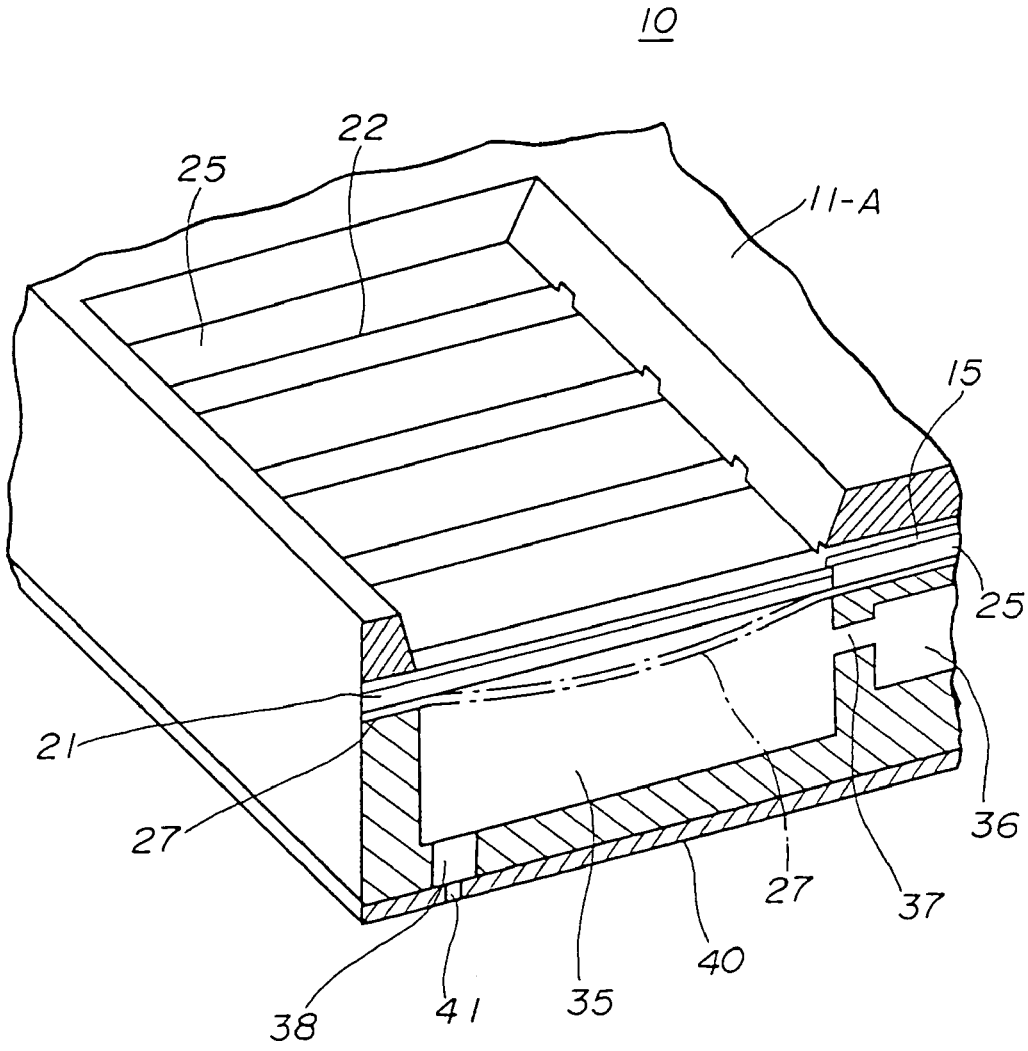
FIG. 5 is a perspective view of the ink-jet recording head of the first embodiment, showing the entire configuration thereof.

Finally, through the above-described processes, the ink-jet recording head 10 shown in FIGS. 4 and 5 is formed.

FIG. 4(A) is a cross-sectional view of the ink-jet recording head 10, showing the outline of a configuration thereof. The individual electrode lead-out parts 15 are joined (in slight contact in this embodiment) to connecting projections 22A of the individual electrode main bodies 22 at the positions offset from the faces including the electrode faces of the individual electrode main bodies 22. The photosensitive polyimide layer 25 is formed in a part where conventionally, piezoelectric elements exist unnecessarily. Accordingly, compared with the conventional ink-jet recording head, stray capacitance can be reduced.

The rate of reduction is given by:

Rate of reduction in capacitance (%)=(Area of individual electrode lead-out part)*100/(Area of piezoelectric element including individual electrode lead-out part).

Further, as shown in FIG. 4(B), which is a bottom view of the ink-jet recording head 10 of FIG. 4(A), a larger area can be secured for the individual electrode lead-out parts 15 than conventionally. Therefore, power supply is in a stable condition, so that the reliability of the ink-jet recording head 10 is increased.

FIG. 5 is a perspective view of the ink-jet recording head 10, showing the entire configuration thereof. In FIG. 5, the ink-jet recording head 10 is shown partially sectioned. By supplying power to the individual electrode lead-out parts 15 and the diaphragm 27, the diaphragm 27 is bent and deformed by displacement based on the piezoelectric elements 21 as shown in the drawing, so that the generated pressure causes ink inside the pressure chambers 35 to be sprayed toward the surface of a recording medium via the ink guide channels 38 and the nozzles 41. Since no piezoelectric elements 21 exist unnecessarily in a part above the ink supply channels 37, ink droplets can be sprayed with a good ink particle characteristic.

[Second Embodiment]

Figure 6:
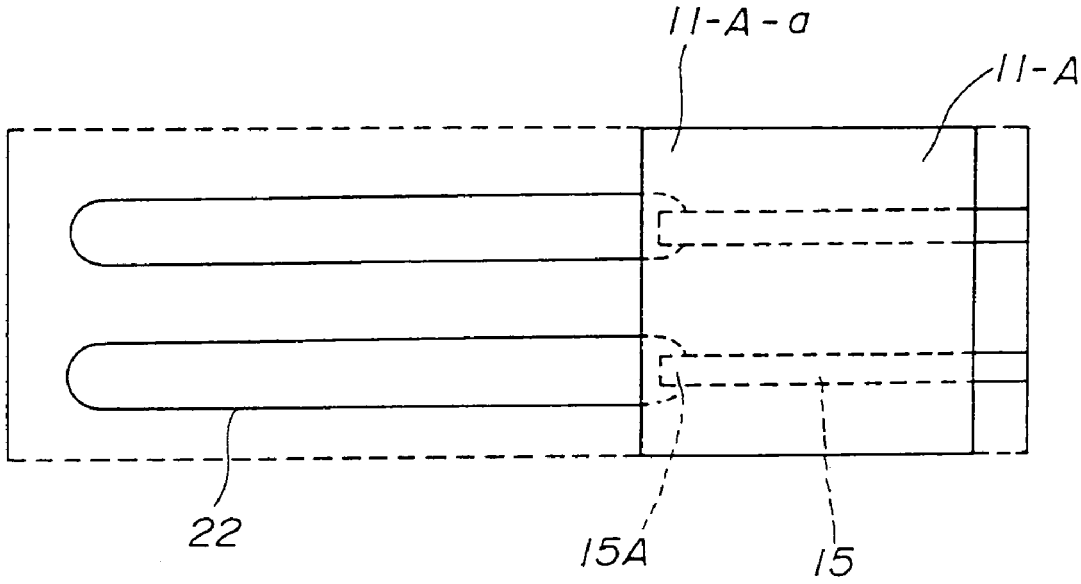
FIG. 6 is a diagram for illustrating a relationship between positions of individual electrode lead-out parts and those of individual electrode main bodies of an ink-jet recording head of a second embodiment.
Figure 7:
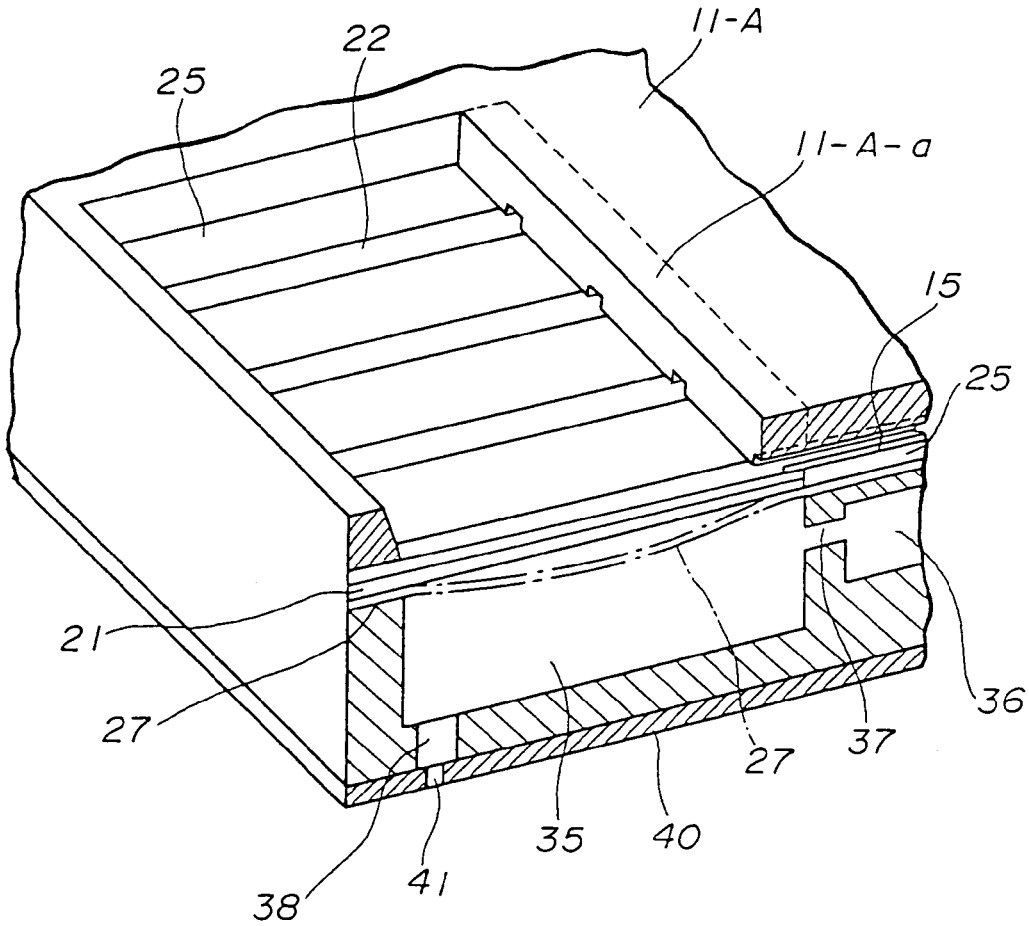
FIG. 7 is a perspective view of the ink-jet recording head of the second embodiment, showing the entire configuration thereof.

FIGS. 6 and 7 show an ink-jet recording head 50 according to a second embodiment of the present invention. The same elements as those of the ink-jet recording head 10 of the first embodiment are referred to by the same numerals.

According to the ink-jet recording head 50 of the second embodiment, the linear individual electrode lead-out parts 15 are positioned to have their surfaces contacting those of the individual electrode main bodies 22 so as to make their joining conditions more reliable.

The ink-jet recording head 50 of the second embodiment can be manufactured in the same way as the above-described ink-jet recording head 10 of the first embodiment. However, when the cutouts 12A for forming the individual electrode lead-out parts 15 in the MgO substrate 11 are defined in FIG. 2(C), the cutouts 12A are designed to overlap the positions where the individual electrode main bodies 22 are formed. By merely forming these cutouts 12A, the positions of the individual electrode main bodies 22 and the positions of the individual electrode lead-out parts 15 overlap each other as shown in FIG. 6 so that the area of the surface where the individual electrode main bodies 22 contact the individual electrode lead-out parts 15 increases. Thereby, power is supplied more smoothly.

In the case of this embodiment, patterning is performed so that the remaining part 11-A of the MgO substrate is further extended to have an additional remaining part 11-A-*a* corresponding to extended parts 15A of the individual electrode lead-out parts 15. According to this configuration, the piezoelectric elements 21, which existed near the area above the ink supply channels 37, are further away therefrom, so that the effects of displacement can be further reduced. Since the upper surfaces of the ink supply channels 37 are prevented from deforming, ink is stably supplied from the common ink channel 36 to the pressure chambers 35. Accordingly, stable ink spraying conditions are secured so that the particle characteristic of the ink sprayed is improved.

If a single-crystal MgO <100> substrate is employed as the MgO substrate 11 used in the embodiment described above in detail, the single-crystal piezoelectric element formation layer 17 having good pressure resistance can be formed. In the case of employing the above-mentioned single-crystal MgO <100> substrate, the process can be performed as in the first embodiment. The same steps are performed until the individual electrode formation layer 16 is formed on the MgO substrate 11 by sputtering in FIG. 2(H). Thereafter, the single-crystal piezoelectric formation layer 17 is grown by epitaxial growth to have a given thickness (for instance, 3 μm). The subsequent steps are performed as in FIG. 2(J) and the subsequent drawings of the first embodiment, so that an ink-jet recording head including a piezoelectric element having good pressure resistance can be manufactured.

Further, a single-crystal Silicon (Si) substrate may be used instead of the MgO substrate. In the case of employing the single-crystal Si substrate, the ink-jet recording head may also be manufactured by performing the steps shown in FIG. 2 in the same manner. Further, the characteristic of the piezoelectric elements 21 can be improved by including, in the manufacturing process, a process of attaching a buffer layer (such as an oxide film) for diffusion prevention between the individual electrode formation layer 16 and the Si substrate.

Figure 8:
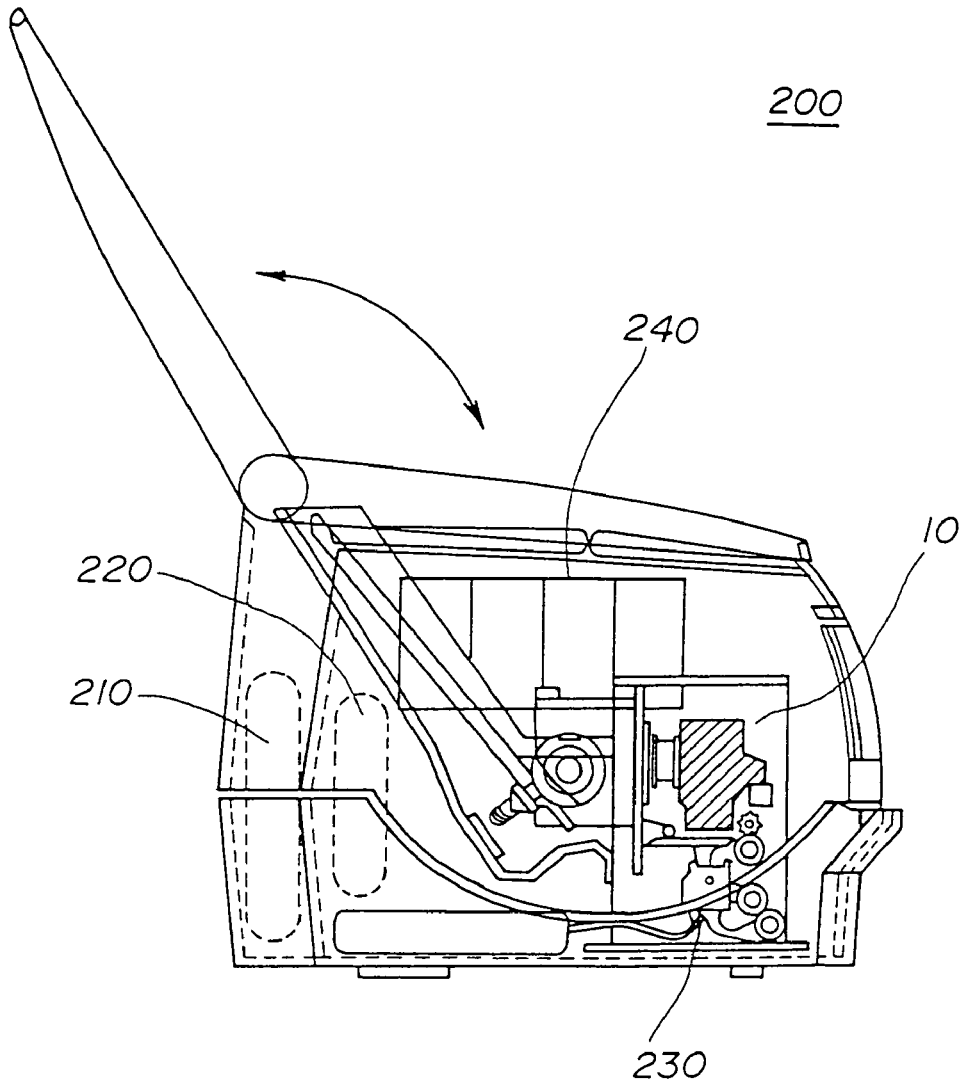
FIG. 8 is a side view of a printer including the ink-jet recording head of the first embodiment.

Each of the ink-jet recording heads shown in the above-described first and second embodiments is used mounted in a printer. FIG. 8 is a schematic side view of a printer 200 including the ink-jet recording head 10 of the first embodiment. The printer 200 includes a power supply part 210, a control part 220, an ink cartridge 240, and a backup unit 230. Since the ink-jet recording head 10 has the above-described various effects, the printer 200 has an improved printing characteristic and can be provided as a printer realizing reduction in driving cost.

The preferred embodiments of the present invention are described above in detail, while the present invention is not limited to the specifically disclosed embodiments, but variations and modifications may be made without departing from the scope of the important aspects of the present invention described later in CLAIMS.

According to the detailedly described ink-jet recording head according to the present invention, the piezoelectric elements exist in parts corresponding to the individual electrode main bodies, and do not exist in the individual electrode lead-out parts. Therefore, the particle characteristic is prevented from being deteriorated by displacement caused by the existence of the piezoelectric elements in areas where no piezoelectric elements are required to be, and there is no need to include capacitance for unnecessary piezoelectric elements. Therefore, the printing characteristic is improved and reduction in driving cost is realized.

Further, the individual electrode lead-out parts of the ink-jet recording head, which, in the manufacturing process, can be formed separately from the individual electrode main bodies at positions offset therefrom, are allowed to have sufficient cross-sectional areas as power supply channels. Therefore, the individual electrode lead-out parts are free of heat generation and line breakage, so that the reliability of the ink-jet recording head is increased.

According to a method of manufacturing the ink-jet recording head, a conductive material formed into the individual electrode lead-out parts is filled into grooves before the individual electrode layer is formed on the substrate. Therefore, the individual electrode lead-out parts can be formed as desired by forming the grooves so that the individual electrode lead-out parts can have such cross sections that allow sufficient power supply.

Further, in the manufacturing process, the individual electrode layer and the piezoelectric element layer are patterned simultaneously, so that processing can be performed with efficiency.

Moreover, the manufacturing method of the present invention can be performed easily by making a simple alteration to the conventional thin-film deposition technology. Therefore, the same facilities as conventionally used can be employed, thus preventing an increase in the cost of facilities.

The invention claimed is:

1. A method of manufacturing an ink-jet recording head including an individual electrode having an individual electrode main body formed at a position corresponding to an ink chamber and an individual electrode lead-out part for supplying power, a piezoelectric element formed to contact the individual electrode, and a diaphragm formed to contact the piezoelectric element, wherein:

the individual electrode lead-out part is disposed in a position vertically offset from the position of the individual electrode main body, said individual electrode lead out part and said individual main body each having continuous, parallel electrode faces which are disposed in mutually parallel, surface-to-surface contact for connecting the individual electrode lead-out part to the individual electrode main body; and the piezoelectric element is formed into a shape corresponding to the individual electrode main body;

the method including a step of simultaneously patterning on a substrate an individual electrode layer and a piezoelectric element layer after successively patterning the individual electrode layer and the piezoelectric element layer on the substrate, the method comprising the step of:

forming a groove for defining an individual electrode lead-out part in the substrate and filling a conductive material into the groove before patterning the individual electrode layer and the piezoelectric element layer on the substrate.

2. The method as claimed in claim 1, including an individual electrode main body formed in the step of patterning the individual electrode layer, and wherein the defined groove extends to a position at which the groove overlaps the individual electrode main body.

* * * * *